United States Patent [19]

Ito et al.

[11] 4,386,769

[45] Jun. 7, 1983

[54] AUTOMATIC PAPER FEEDING ARRANGEMENT

[75] Inventors: Masazumi Ito, Toyokawa; Kenji Shibazaki, Aichi; Tsuneo Kitagawa, Toyohashi, all of Japan

[73] Assignee: Minolta Camera Kabushiki Kaisha, Osaka, Japan

[21] Appl. No.: 251,283

[22] Filed: Apr. 6, 1981

[30] Foreign Application Priority Data

Feb. 17, 1981 [JP] Japan ..... 56/22686

[51] Int. Cl.[3] ..... B65H 3/44

[52] U.S. Cl. ..... 271/9; 271/111; 271/154; 271/159

[58] Field of Search ..... 271/9, 152, 154, 158, 271/159, 164, 111

[56] References Cited

U.S. PATENT DOCUMENTS 3,977,666 8/1976 Suzuki ..... 271/164 X 4,108,427 8/1978 Komori ..... 271/111 X

FOREIGN PATENT DOCUMENTS 1402971 8/1975 United Kingdom ..... 271/9

*Primary Examiner*—Richard A. Schacher

*Attorney, Agent, or Firm*—Wenderoth, Lind & Ponack

[57] ABSTRACT

An automatic paper feeding arrangement for use in a copying machine and the like having a plurality of stages of paper feeding sections for feeding the paper at a selected one of the paper feeding sections. The automatic paper feeding arrangement includes a circuitry for detecting the presence of the paper at each of the paper feeding sections, and a control circuit for cancelling the designation of the paper feeding section previously effected, based on the signal from the detecting circuit when the paper becomes absent in each of the paper feeding sections, and also for designating the paper feeding section in which the paper is initially loaded, based on the signal from the detecting circuit when the paper is loaded in any of the paper feeding sections.

12 Claims, 8 Drawing Figures

AUTOMATIC PAPER FEEDING ARRANGEMENT

BACKGROUND OF THE INVENTION

The present invention generally relates to a paper feeding arrangement and more particularly, to an automatic paper feeding arrangement for use, for example, in a copying machine, facsimile equipment, printer or the like having a plurality of stages of paper feeding sections.

Commonly, for example, in a copying machine having a plurality of stages of copy paper feeding sections, there is provided means for enabling an operator to select and designate any desired one of the copy paper feeding sections, while some of the copying machines are additionally provided with a function for automatically and preferentially designating a particular one of the copy paper feeding sections for an initial setting, upon the turning ON of the power supply.

In the copying machines of the above described type, when copy paper is not present at any of the copy paper feeding sections and therefore, copy paper is to be newly loaded for copying, if the copy paper is loaded onto the copy paper feeding section preliminarily selected or preferentially designated, the copying may be immediately started. However, in some cases, it becomes necessary to load other undesignated copy paper feeding sections with copy paper for copying, and in such a case, operations for selecting and designating the other copy paper feeding sections are required, thus imposing troublesome procedures to the operator.

The copy paper to be loaded in the copy paper feeding sections may be in the form of either a rolled paper or copy paper sheets, but the disadvantages as described above will be explained more specifically hereinbelow with reference to the copy paper sheets.

The copy paper sheets are normally accommodated in copy paper feeding cassettes respectively for predetermined sizes such as B4, A4, etc., and these copy paper feeding cassettes are loaded onto the copy paper feeding sections provided in a housing of the copying machine for carrying out copying. In the above case, it is a general practice to load the copy paper feeding section at the uppermost stage, with copy paper sheets of a size most frequently used. In other words, the necessity for copy paper replenishment increases with the increase of using frequency, and thus, the uppermost stage where the copy paper replenishment is most readily effected, is utilized. For the similar reason, the uppermost stage is also selected for the preferential designation, while copy paper sheets with less using frequency are loaded onto the other copy paper feeding sections.

In the above arrangement, the handling may be most facilitated, if the cassette at the uppermost stage is replenished with the copy paper when the copy paper sheets in all of the copy paper feeding sections have been used up. However, in the case where the copy paper feeding sections at the lower stages are selected for designation, the operator is obliged either to reselect the uppermost stage for designation of the copy paper feeding after loading the uppermost stage or to replenish the copy paper feeding section at the lower stage preliminarily selected for designation, with the copy paper sheets through troublesome procedures for the replenishment.

SUMMARY OF THE INVENTION

Accordingly, an essential object of the present invention is to provide an automatic paper feeding arrangement for use, for example, in a copying machine, facsimile equipment, printer or the like in which loading work of paper and troublesome procedures for selecting and designating particular paper feeding sections associated therewith, are eliminated for an efficient copying operation.

Another important object of the present invention is to provide an automatic paper feeding arrangement of the above described type which is simple in construction and stable in functioning at a high reliability, and can be readily incorporated into copying machines and the like at a low cost.

In accomplishing these and other objects, according to one preferred embodiment of the present invention, there is provided an automatic paper feeding arrangement for use in a copying machine and the like and having a plurality of stages of paper feeding sections for feeding the paper at selected one of the paper feeding sections. The automatic paper feeding arrangement includes a circuit for detecting the presence or absence of the paper at each of the paper feeding sections, and the control circuitry for cancelling designation of the paper feeding section previously effected, based on the signal from the detecting circuitry when the paper becomes absent in each and every one of the paper feeding sections, and also for designating the paper feeding section in which the paper is initially loaded, based on the signal from the detecting circuitry when the paper is loaded in any of the paper feeding sections under the condition where no papers are present in each and every one of the paper feeding sections.

By the above arrangement according to the present invention, an improved automatic paper feeding arrangement has been advantageously presented, with a substantial elimination of disadvantages inherent in the conventional arrangements of this kind.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like functions are designated by like symbols throughout several views of the accompanying drawings.

DETAILED DESCRIPTION OF THE INVENTION

Figure 1:
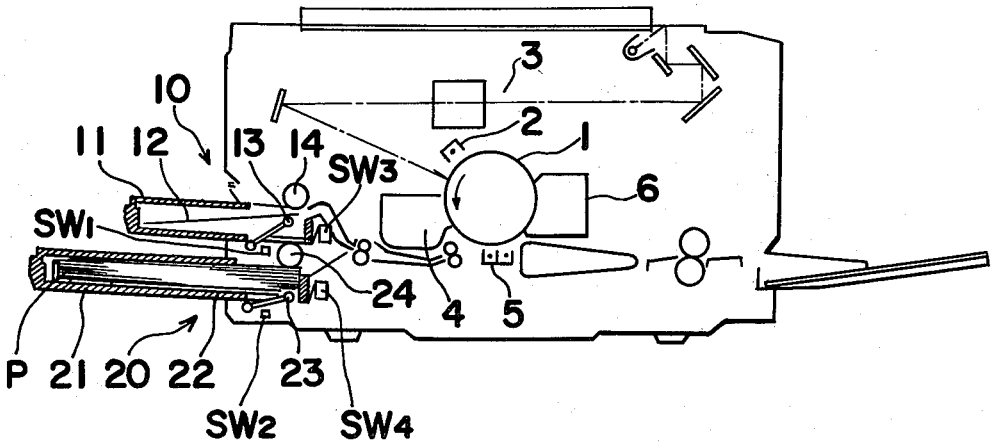
FIG. 1 is a schematic side sectional view of an electrophotographic copying machine to which an automatic paper feeding arrangement according to the present invention may be applied.

Referring now to the drawings, there is shown in FIG. 1 an electrophotographic copying machine in which an automatic paper feeding arrangement according to the present invention is incorporated. The copying machine of FIG. 1 has a photosensitive or photoreceptor drum 1 which is rotatably provided at approximately a central portion of a machine housing for rotation in the counterclockwise direction, and around which there are sequentially disposed in a known manner, a corona charger 2 for preliminarily charging the surface of the photoreceptor drum 1, an optical system 3 for projecting an image of an original to be copied (not shown) onto the surface of the photoreceptor drum 1 so as to form an electrostatic latent image of the original thereon, a magnetic brush developing apparatus 4 for developing the electrostatic latent image into a visible toner image, a transfer charger 5 for transferring the visible image onto copy paper, and a cleaning device 6 for cleaning the surface of the photoreceptor drum 1 after the transfer.

Meanwhile, the automatic paper feeding arrangement directly relates to the present invention is provided with a two stage copy paper feeding section including an upper copy paper feeding section 10 and a lower copy paper feeding section 20, in which copy paper cassettes 11 and 21 each accommodating stacks of copy paper sheets P of predetermined sizes are releasably mounted respectively as shown. The stacks of copy paper sheets P contained in the cassettes 11 and 21 are arranged to be raised, at leading edges thereof, from the bottom sides of the cassettes 11 and 21 by push-up rollers 13 and 23, which are respectively mounted at forward ends of lever members provided for pivotal movement below openings formed in the corresponding portions of the bottom walls of the cassettes 11 and 21, through base plates 12 and 22 for pressure contact with corresponding copy paper feed rollers 14 and 24 rotatably provided in positions adjacent to and above the leading edges of the copy paper sheets. The copy paper feeding rollers 14 and 24 are so arranged that either one of them is selectively driven for rotation according to designation signals for the copy paper feeding section so as to feed, one sheet by one sheet, the copy paper sheet at the topmost layer of the stack. The automatic copy paper feeding arrangement as described above further includes photoelectric switches SW1 and SW2 provided adjacent to and below the push-up rollers 13 and 23 for the cassettes 11 and 21 for directly detecting the presence of the copy paper sheets in said cassettes 11 and 21, and limit switches SW3 and SW4 respectively provided in positions confronting the corresponding edges of the cassettes 11 and 21 so as to function according to mounting and dismounting of the cassettes 11 and 21 for indirectly detecting the presence of the copy paper sheets at the feeding sections 10 and 20.

In actual practice, either the set of switches SW1 and SW2 or the set of switches SW3 and SW4 may be employed as a copy paper detecting means.

Figure 2:
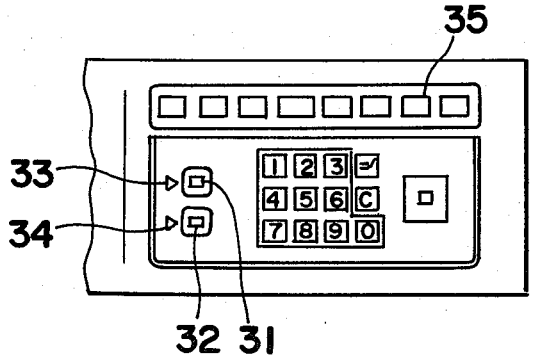
FIG. 2 is a fragmentary top plan view showing, on an enlarged scale, a control panel employed in the copying machine of FIG. 1.

The copying machine of FIG. 1 is provided with a function for preferentially designating the upper copy paper feeding section 10 at the initial setting upon the turning ON of the power supply, and another function for selecting and designating either one of the copy paper feeding section 10 or 20 by an upper copy paper feeding selection button 31 and a lower copy paper feeding selection button 32 which are provided on a control panel as shown in FIG. 2.

Figure 3:
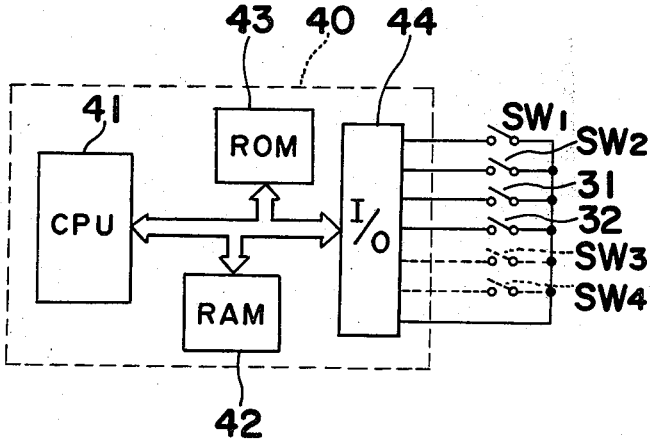
FIG. 3 is an electrical block diagram showing the construction of a micro-computer employed in the arrangement of FIG. 1.

The functions as described above are effected together with control of other functions by a micro-computer 40 fundamentally including a central processing unit (CPU) 41, a random access memory (RAM) 42, a read only memory (ROM) 43 and an input/output interface (I/O) 44 as shown in FIG. 3.

More specifically, the signals from the copy paper detecting switches SW1 and SW2 and copy paper selection buttons 31 and 32 are fed into the micro-computer 40 through the input/output interface 44 so as to be processed therein for effecting various controls. The controls for the copy paper feeding includes energization and de-energization of indication lamps 33 and 34 (FIG. 2) and driving control of the copy paper feeding rollers 14 and 24 following the selection designation (i.e. determination of adoption of the upper copy paper feeding section 10 or the lower copy paper feeding section 20 by an operator with the use of the selection button 31 or 32) and the preferential designation (i.e. preferential designation of either one of the copy paper feeding section 10 or 20 upon turning ON of the power supply. In this embodiment, the upper copy paper feeding section 10 is preferentially designated), and further, energization and de-energization of an empty indication lamp 35, etc. (FIG. 2).

Figure 4:
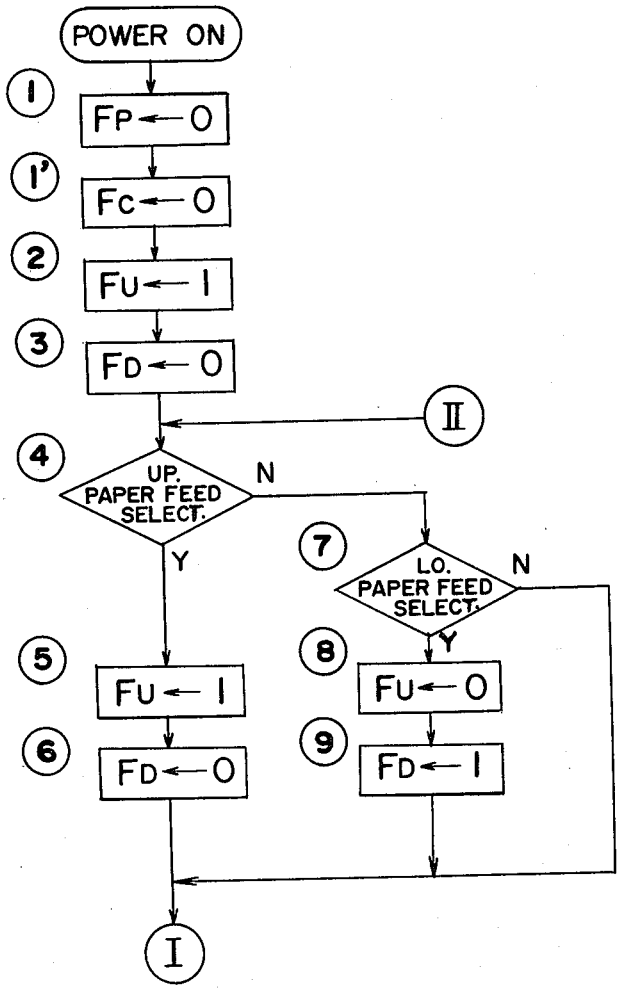
FIGS. 4 and 5 are flow charts explaining the functions of the automatic paper feeding arrangement according to one preferred embodiment of the present invention.
Figure 5:
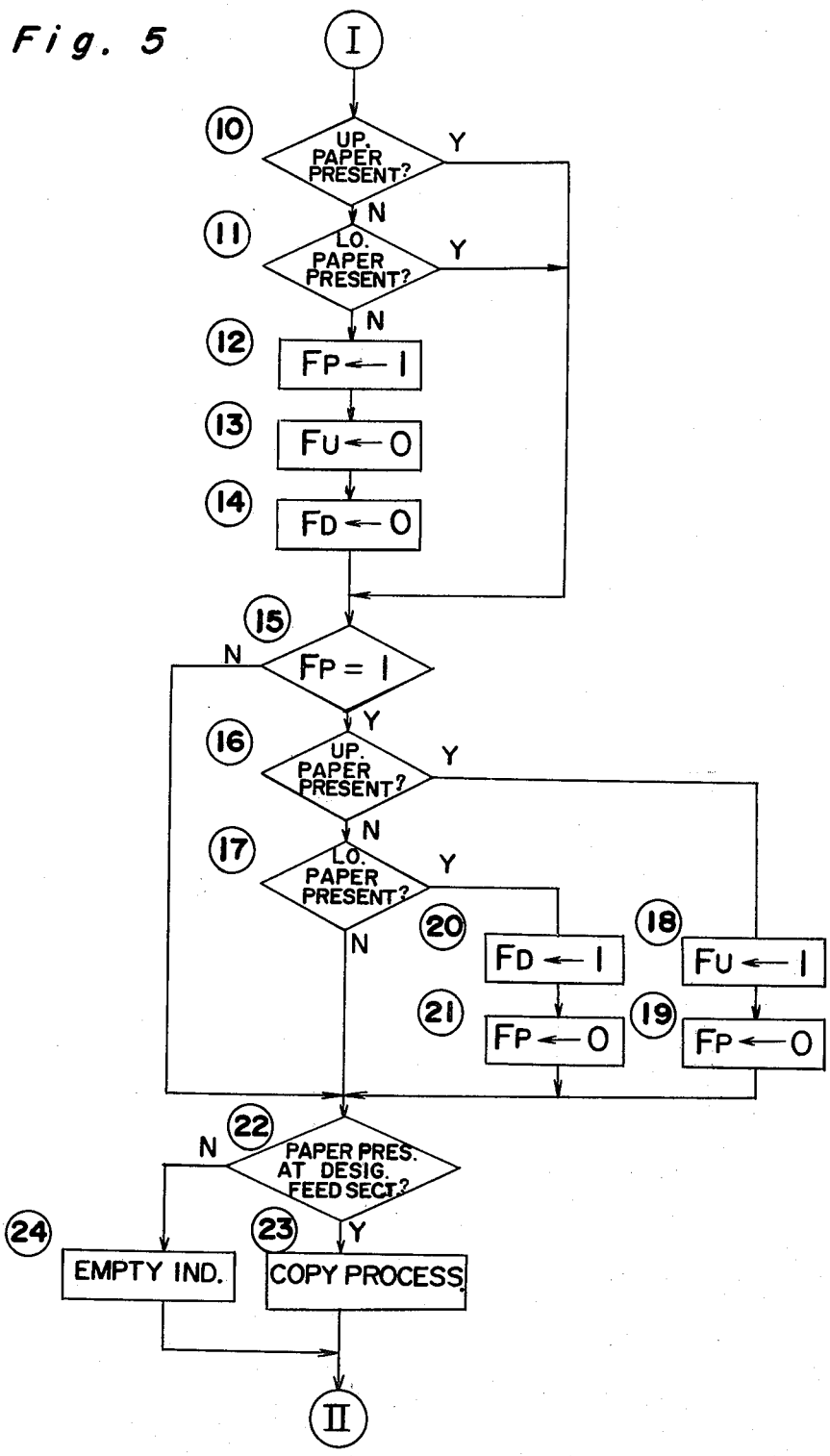

Referring to FIGS. 4 and 5 showing flow-charts for explaining the functionings of the automatic paper feeding arrangement according to one preferred embodiment of the present invention in which presence or absence of the copy paper sheets is directly detected by the switches SW1 and SW2, upon the turning ON of the power supply in the first place, a paper flag ($F_P$) is set to "0" at step ①. It is to be noted that step ①' is to be used instead of step ① in a modification of the present invention described later with reference to FIG. 6. The above flag ($F_P$) prohibits the copying functions when it is "1" for processing to be mentioned later.

Subsequently, at step ②, an upper copy paper feeding flag ($F_U$) is set to "1," and at step ③, a lower copy paper feeding flag ($F_D$) is set to "0." These flags ($F_U$) and ($F_D$) enable the copy paper feeding when set to "1" and prohibit the copy paper feeding when set to "0." Steps ② and ③ are for the preferential designation at the initial setting, and in this case, the upper copy paper feeding section 10 is preferentially designated.

Subsequent steps ④, ⑤, ⑥, ⑦, ⑧ and ⑨ are routines for selection designation, and at step ④, it is determined whether or not the upper copy paper feeding section 10 has been selected, i.e. whether or not the selection button 31 is turned ON, and if YES, the flag ($F_U$) is set to "1" at step ⑤, and the flag ($F_D$) is set to "0" at step ⑥. If NO, at step ⑦, it is determined whether or not the lower copy paper feeding section 20 has been selected, i.e. whether or not the selection button 32 is turned ON, and if YES, the flag ($F_U$) is set to "0" at step ⑧, and the flag ($F_D$) is set to "1" at step ⑨. In the case of NO, no function occurs and the next step is considered.

In the next step ⑩ (FIG. 5), it is determined whether or not copy paper sheets are present in the upper copy paper feeding section 10, i.e. whether or not the switch SW1 is ON. If NO at step ⑩, it is also determined, at a step ⑪, whether or not the copy paper sheets are present in the lower copy paper feeding section 20, i.e. whether or not the switch SW2 is ON. In the case where at least one of the step ⑩ or ⑪ determinations is YES, the step is shifted to step ⑮, but if both of the step ⑩ and ⑪ determinations are NO, the flag ($F_P$) is set to "1" at step ⑫, the flag ($F_U$) is set to "0" at step ⑬, and the flag ($F_D$) is set to "0" at step ⑭. In short, at these steps ⑫, ⑬ and ⑭, the copying is prohibited and the selection designations effected previously (in which either one of the flag ($F_U$) or ($F_D$) is "1") are cancelled.

In the subsequent step ⑮, it is determined whether or not the flag ($F_P$) is "1," and if YES, it is determined, at steps ⑯ and ⑰, whether or not the copy paper sheets are present at the upper copy paper feeding section 10 and lower copy paper feeding section 20. If the step ⑯ determination is YES, the flag ($F_U$) is set to "1" at step ⑱, and the flag ($F_P$) is set to "0" at step ⑲. When the step ⑯ determination is NO and the step ⑰ determination being YES, the flag ($F_D$) is set to "1" at step ⑳, and the flag ($F'_P$) is set to "0" at step ㉑.

By the above steps ⑯ to ㉑, when copy paper sheets are newly loaded onto the upper and lower copy paper feeding sections 10 and 20 under the state where no copy paper sheets are present at each of the feeding sections 10 and 20, processing is effected so as to designate either one of the upper or lower copy paper feeding sections 10 or 20 which is initially loaded with the copy paper sheets.

In the case of NO determinations at step ⑮ and step ⑰, and following the steps ⑲ and ㉑, processing for step ㉒ is effected. Step ㉒ is intended to determine whether or not the copy paper sheets are present at the designated copy paper feeding section, and if YES, the step reverts to step ③ after effecting copying processing at step ㉓. If the step ㉒ determination is NO, the empty indication lamp 35 is illuminated at step ㉔, and the step reverts to step ③ without effecting the copying processing.

It is to be noted here that, in the copying processing at step ㉓, there is included the control for effecting the copy paper feeding by driving for rotation, either one of the copy paper feeding rollers 14 or 24 at the copy paper feeding section in which the flags $F_U$ and $F_D$ are "1" in steps ⑱ or ⑳, and also for illuminating either one of the indication lamps 33 or 34.

The embodiment so far described relates to an instance where the copy paper sheets are accommodated in the copy paper feeding cassettes 11 and 21 and said cassettes 11 and 21 are loaded on the copy paper feeding sections 10 and 20 as shown in FIG. 1. In the above case, the state where the copy paper sheets are not present at the upper and lower copy paper feeding sections 10 and 20 (i.e. the state where both of the determinations of steps ⑩ and ⑪ are NO), includes the cases as follows. That is to say:

(I) A case where no copy paper sheets are accommodated in the cassettes 11 and 21, although the cassettes 11 and 21 are respectively mounted in both of the copy paper feeding sections 10 and 20;

(II) another case where the cassette 11 or 21 is mounted only in one of the feeding sections 10 or 20, and the cassette thus mounted has no copy paper sheets accommodated therein; and (III) still another case where the cassettes 11 and 21 are not loaded in the feeding sections 10 and 20.

In the above-noted case (I), either of the cassettes 11 and 21 may be replenished with the copy paper sheets, and in the above-noted case (II), the cassette mounted in the feeding section may be replenished with the copy paper sheets or the cassette which is not mounted in the feeding section may be replenished with the copy paper sheets for subsequent mounting in the corresponding copy paper feeding section, while in case (III), either of the copy paper feeding sections 10 and 20 may be loaded with the cassette replenished with the copy paper sheets.

Common to all of the cases as described above, the copy paper feeding section at the side where the copy paper sheets are supplied, is automatically designated irrespective of the previous selection designation or preferential designation. Accordingly, it is possible for the operator to immediately start copying without any troublesome procedures such as alterations of the designation.

It should be noted here that, in the foregoing embodiment of FIGS. 4 and 5, although the present invention is mainly described with reference to the arrangement in which the copy paper sheets are employed, the concept of the present invention is not limited in its application to the arrangement of the above described type alone, but may readily be applicable to arrangements of various types employing, for example, copy paper in a roll form, or arrangements wherein copy paper sheets are directly mounted on a fixed copy paper feeding table, or to a combination of such types.

Figure 6:
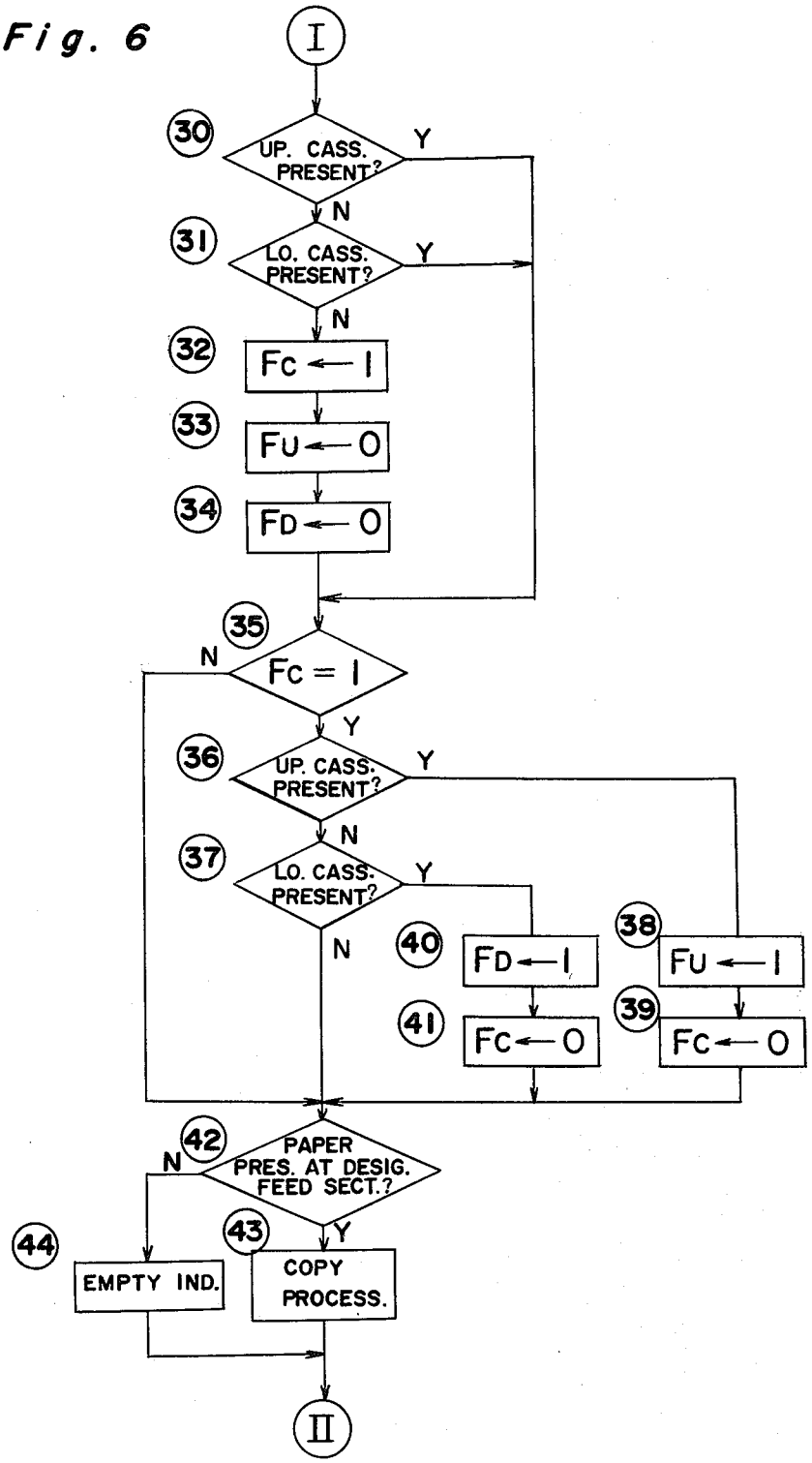
FIG. 6 is a flow chart explaining with FIG. 4 the functions of the automatic paper feeding arrangement according to a modification of the present invention.

Reference is made to FIG. 6 showing a flow chart for explaining functionings of the automatic paper feeding arrangement according to a modification of the present invention.

It is to be noted that in FIG. 6, step ㉚ continues from the symbol Ⓘ at the bottom of the flow chart in FIG. 4.

In this modification of FIG. 6, it is so arranged that the switches SW3 and SW4 indirectly detect the presence of copy paper sheets by being actuated upon mounting or dismounting of the copy paper feeding cassettes 11 and 21. Therefore, in FIG. 4, the cassette flag ($F_C$) of step ①' is inserted instead of the paper flag ($F_P$) of step ①.

In other words, as described earlier, the upper copy paper feeding section 10 is preferentially designated at steps ② and ③, and at steps ④ to ⑨, it is determined whether or not the selection designation has been effected.

In step ㉚, it is determined whether or not the upper cassette 11 is present, i.e. whether or not the switch SW3 is in the ON state. If a NO determination occurs at step ㉚, it is determined at step ㉛, whether or not the lower cassette 21 is present, i.e. whether or not the switch SW4 is in the ON state. When at least one of the determinations of steps ㉚ and ㉛ is YES, the step is shifted to step ㉟, but if both of the determinations of steps ㉚ and ㉛ are NO, the flag ($F_C$) is set to "1" at step ㉜, the flag ($F_U$) is set to "0" at step ㉝, and the flag ($F_D$) is set to "0" at step ㉞ so as to cancel the selection designations effected before that time.

In step ㉜, it is determined whether or not the flag ($F_C$) is "1", and if YES, it is determined at steps 36 and 37 whether or not the cassettes 11 and 21 are present at the upper and lower copy paper feeding sections 10 and 20. Subsequently, at steps 36, 37, 38, 39, 40 and 41, when the cassettes 11 and 21 are newly loaded in the upper and lower copy paper feeding sections 10 and 20 under the state where no cassettes 11 and 21 are present in each of the copy paper feeding sections 10 and 20, processing is effected for designating either the upper feeding section 10 or lower feeding section 20, whichever has been initially loaded.

In the next step 42, it is determined whether or not the cassette is present at the designated copy paper feeding section, and if YES, the step reverts to step 3 after effecting the copying processing at step 43. In the case of a NO determination, the empty indication lamp 35 is illuminated at step 44, and the step reverts to step 3 without effecting the copying processing.

In the modification of FIG. 6, with respect to case (III) as described with reference to the first embodiment of FIGS. 4 and 5, i.e. when the cassettes 11 and 21 are not loaded in either of the copy paper feeding sections 10 and 20, the particular one of the feeding sections 10 and 20 in which the cassette 11 or 21 is initially mounted is automatically designated.

Figure 7:
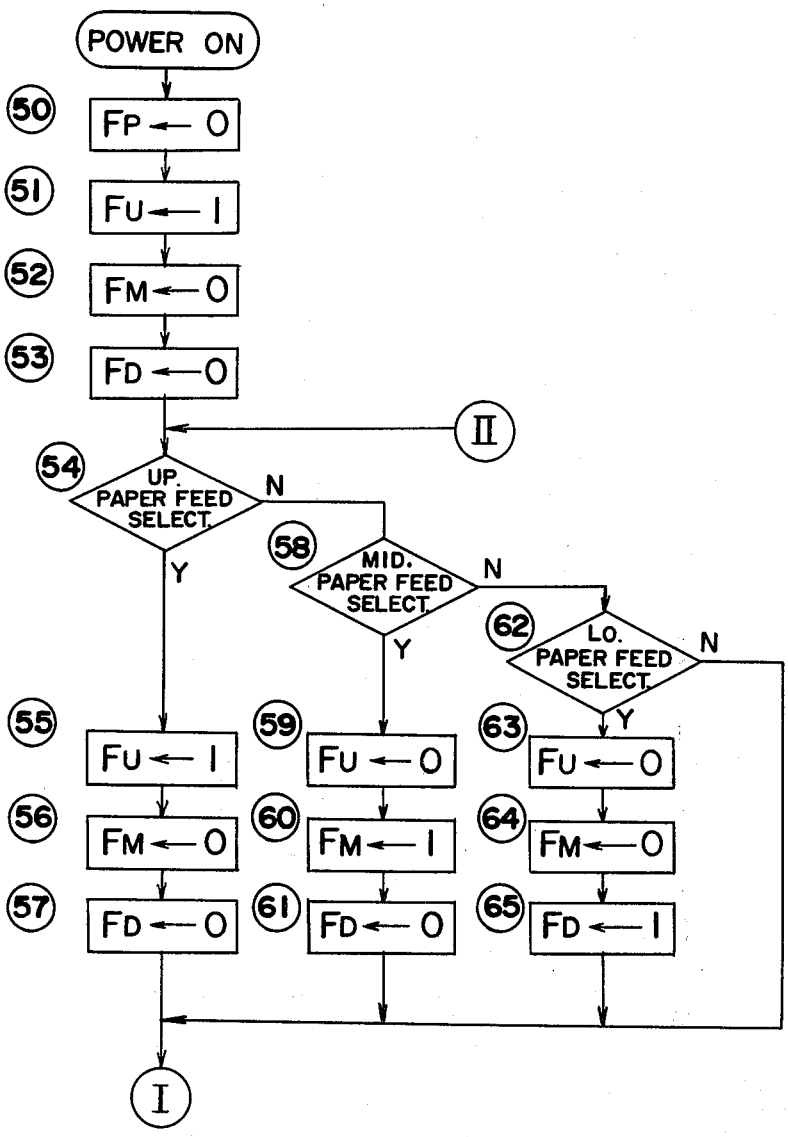
FIGS. 7 and 8 are flow charts similar to FIGS. 4 and 5, which particularly show the functions of the automatic paper feeding arrangement according to another modification of the present invention.
Figure 8:
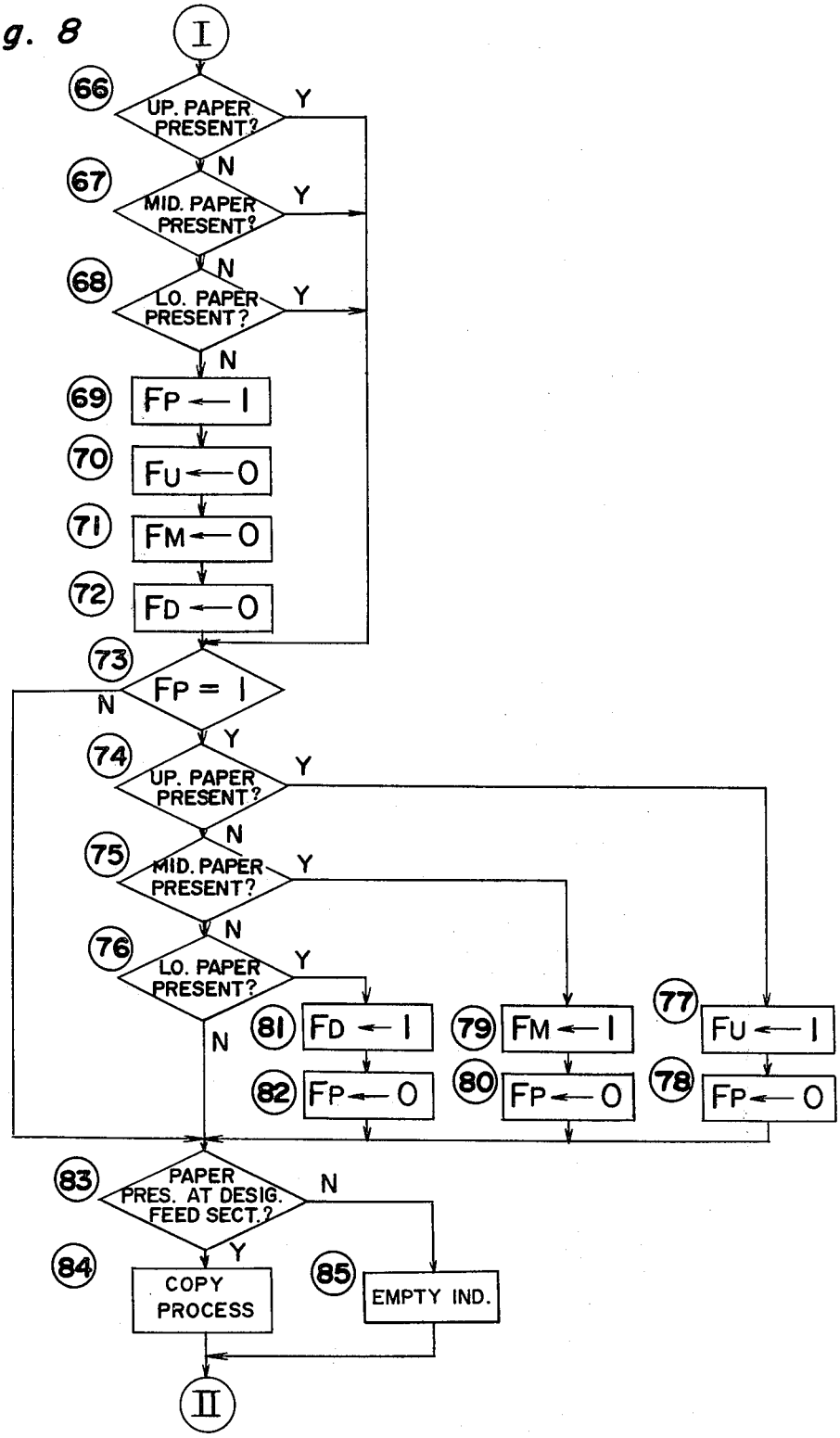

Reference is further made to FIGS. 7 and 8 showing flow charts explanatory of functionings of the automatic paper feeding arrangement according to another modification of the present invention.

In the modification as illustrated in FIGS. 7 and 8, it is arranged so that copy paper feeding sections in three stages, i.e. upper, middle and lower copy paper feeding sections are provided in comparison with the arrangements of FIG. 4, and FIG. 5 or 6 in which the upper and lower copy paper feeding sections are provided in two stages, and that the presence of the copy paper sheets are directly effected by the switches SW1 and SW2, and also by another photoelectric switch which detects presence of copy paper sheets in the middle copy paper feeding section. Accordingly, in the flow charts of FIGS. 7 and 8, the flow chart for the middle copy paper feeding section is further added to the flow charts of FIGS. 4 and 5. More specifically, between steps 51 and 53 for the preferential designation, a step 52 for setting a middle copy paper feeding flag ($F_M$) to "0" is inserted, while between steps 54 and 62 which are the routine for the selection designation, a step 58 is inserted for determining whether or not the middle copy paper feeding section is selected. In the case where the middle copy paper feeding section is selected and the step 58 determination is YES, the upper copy paper feeding flag ($F_U$) is set to "0" at step 59, the middle copy paper feeding flag ($F_M$) is set to "1" at step 60, and the lower copy paper feeding flag ($F_D$) is set to "0" at step 61. Moreover, between steps 66 and 68 (FIG. 8) for ensuring the presence of the copy paper sheets after the selection designation, a step 67 is inserted for checking whether or not copy paper sheets are present in the middle copy paper feeding section, while another step 71 is inserted for setting the middle copy paper feeding flag ($F_M$) to "0" when copy paper sheets are not detected in each of the copy paper feeding sections immediately thereafter. Subsequently, between copy paper confirming steps 74 and 76 after checking whether or not the flag ($F_P$) is "1" (YES), a step 75 is inserted for confirming whether or not the copy paper sheets are present at the middle copy paper feeding section, while a step 79 for setting the middle copy paper feeding flag ($F_M$) to "1" when the step 75 determination is YES, and a step 80 for setting the flag ($F_P$) to "0," are further inserted.

It should also be noted here that in the above-noted modification of FIGS. 7 and 8, the switches SW3, SW4 and another switch for the middle copy paper cassette may further be added for indirectly detecting the presence or absence of the copy paper sheets in a similar manner as in the arrangement of FIG. 6.

It should also be noted that, in the foregoing embodiments, although the present invention has been mainly described with reference to an electrophotographic copying machine, the concept of the present invention is not limited in its application to the electrophotographic copying machines alone, but may readily be applied to automatic paper feeding arrangements, for example, for facsimile equipment, printers, intelligent copiers and the like.

As is clear from the foregoing description, since the automatic paper feeding arrangement according to the present invention includes the means for detecting presence of paper at each of the paper feeding sections, and the control means for cancelling designation of the paper feeding section previously effected, based on the signal from the detecting means when the paper becomes absent in each of the paper feeding sections, and also for designating the paper feeding section in which the paper is initially loaded, based on the signal from the detecting means when the paper is loaded in any of the paper feeding sections, designation is automatically effected to the paper feeding section newly loaded with the paper irrespective of the previous designation, even if the operator loads any of the paper feeding sections with the paper, and thus troublesome and time consuming procedures such as the selective loading of the copy paper, and selection and designation of the copy paper feeding sections associated therewith, may be advantageously eliminated.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An automatic paper feeding arrangement for use in a copying machine and the like and having a plurality of stages of paper feeding sections for feeding paper from a selected one of the paper feeding sections, said automatic paper feeding arrangement comprising means for detecting a presence or absence of paper at each of the paper feeding sections, and a control means for cancelling a designation of the paper feeding section previously effected therebefore, based on a signal from said detecting means which is generated when the paper is detected as being absent from each and every one of said paper feeding sections, and for also designating the paper feeding section in which the paper is initially loaded, based on the signal from said detecting means which is generated when the paper is loaded in any one of said paper feeding sections under the condition that papers were previously absent from each and every one of said paper feeding sections.

2. An automatic paper feeding arrangement as claimed in claim 1, wherein said plurality of stages of the paper feeding sections comprise two stages.

3. An automatic paper feeding arrangement as claimed in claim 1, wherein said plurality of stages of the paper feeding sections comprise three stages.

4. An automatic paper feeding arrangement as claimed in claim 1, wherein said paper comprises cut paper sheets of predetermined sizes to be respectively loaded in said plurality of stages of the paper feeding sections.

5. An automatic paper feeding arrangement for use in a copying machine and the like and having a plurality of stages of paper feeding sections for feeding paper from a selected one of the paper feeding sections, said automatic paper feeding arrangement comprising means for detecting a presence or absence of paper at each of the paper feeding sections, said detecting means further including switch members provided in each of said plurality of stages of the paper feeding sections so as to directly detect the presence and absence of the paper thereat, and a control means for cancelling a designation of the paper feeding section previously effected therebefore, based on a signal from said detecting means which is generated when the paper is detected as being absent in each and every one of said paper feeding sections, and for also designating the paper feeding section in which the paper is initially loaded, based on the signal from said detecting means which is generated when the paper is loaded in any one of said paper feeding sections under the condition that papers were previously absent from each and every one of said paper feeding sections.

6. An automatic paper feeding arrangement as claimed in claim 5, wherein said plurality of stages of the paper feeding sections comprise two stages which are respectively loaded with paper of predetermined sizes.

7. An automatic paper feeding arrangement as claimed in claim 5, wherein said plurality of stages of the paper feeding sections comprise three stages which are respectively loaded with paper of predetermined sizes.

8. An automatic paper feeding arrangement as claimed in claim 5, wherein said paper comprises cut copy paper sheets of predetermined sizes which are respectively loaded in said plurality of stages of the paper feeding sections.

9. An automatic paper feeding arrangement for use in a copying machine and the like and having a plurality of stages of paper feeding sections for feeding paper from a selected one of the paper feeding sections, said automatic paper feeding arrangement comprising means for detecting a presence or absence of paper at each of the paper feeding sections, said detecting means further including switch members provided in each of said plurality of stages of the copy paper feeding sections so as to indirectly detect the presence and absence of the paper thereat through the detection of a presence or absence of cassettes in which paper of predetermined sizes are respectively accommodated, and a control means for cancelling a designation of the paper feeding section previously effected therebefore, based on a signal from said detecting means which is generated when the cassette becomes absent in each and every one of said paper feeding sections, and for also designating the paper feeding section in which the cassette is initially loaded, based on the signal from said detecting means which is generated when the cassette is loaded in any one of said paper feeding sections under the condition that cassettes were previously absent from each and every one of said paper feeding sections.

10. An automatic paper feeding arrangement as claimed in claim 9, wherein said plurality of stages of the paper feeding sections comprise two stages which are respectively loaded with the cassettes containing paper of predetermined sizes.

11. An automatic paper feeding arrangement as claimed in claim 9, wherein said plurality of stages of the paper feeding sections comprise three stages which are respectively loaded with the cassettes containing paper of predetermined sizes.

12. An automatic paper feeding arrangement as claimed in claim 9, wherein said paper comprises cut paper sheets of predetermined sizes which are respectively contained in said cassettes and loaded in said plurality of stages of the paper feeding sections.

* * * * *